US007645952B2

(12) United States Patent
Bolle et al.

(10) Patent No.: US 7,645,952 B2
(45) Date of Patent: Jan. 12, 2010

(54) MECHANICAL SWITCH WITH MELTING BRIDGE

(75) Inventors: Cristian A Bolle, Bridgewater, NJ (US); Brijesh Vyas, Warren, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 181 days.

(21) Appl. No.: 11/518,693

(22) Filed: Sep. 11, 2006

(65) Prior Publication Data

US 2008/0061911 A1 Mar. 13, 2008

(51) Int. Cl.
*H01H 29/00* (2006.01)

(52) U.S. Cl. ..... 200/182; 200/181; 335/79

(58) Field of Classification Search ..... 335/78; 200/181, 182

See application file for complete search history.

(56) References Cited

U.S. PATENT DOCUMENTS

| | | | | |
|---|---|---|---|---|
| 6,512,322 | B1 * | 1/2003 | Fong et al. | 310/328 |
| 6,689,976 | B1 * | 2/2004 | Dove et al. | 200/182 |
| 6,864,767 | B2 * | 3/2005 | Streeter et al. | 335/78 |
| 7,189,934 | B2 * | 3/2007 | Youngner | 200/182 |
| 2003/0131595 | A1 * | 7/2003 | Takeuchi et al. | 60/413 |

OTHER PUBLICATIONS

U.S. Appl. No. 11/519,142, Pardo, filed Sep. 11, 2006.

Martin C. Geear, et al, "Microengineered Electrically Resettable Circuit Breaker," *Journal of Microelectronmechanical Systems*, vol. 13, No. 6, (Dec. 2004), pp. 887-894.

Helmut F. Schlaak, "Potentials and Limits of Micro-Electromechanical Systems for Relays and Switches," *21st International Conference on Electrical Contacts*, (Sep. 9-12, 2002), pp. 19-30.

D. J. Bell, et al, "MEMS Actuators and sensors: observations on their performance and selection for purpose," Journal of Micromechanics and Microengineering, (2005), pp. S153-S164.

Vivek Agrawal, "A Latching MEMS Relay for DC and RF Applications," *Proceedings of the 50th IEEE Holm Conference on I Contacts and the 22nd International Conference on Electrical Contacts* (2004), pp. 222-225.

Stafford Johnson, "MetalMUMPS Process Flow," available online at http://www.memsrus.com/documents/MetalMUMPs.flow.ppt, (prior to Sep. 2006), pp. 1-27.

Bryan Derksen, "Mercury switch," available online at: http://en.wikipedia.org/wiki/Mercury_switch, (Aug. 17, 2006), 1 page.

You Kondoh, et al, "High-Reliability, High-Performance RF Micromachined Switch Using Liquid Metal," *Journal of Microelectromechanical Systems*, vol. 14, No. 2, (Apr. 2005), pp. 214-220.

Jonathan Simon, et al, "A Liquid-Filled Microrelay with a Moving Mercury Microdrop," *Journal of Microelectromechanical Systems*, vol. 6, No. 3, (Sep. 1997), pp. 208-216.

* cited by examiner

*Primary Examiner*—Elvin G Enad
*Assistant Examiner*—Bernard Rojas
(74) *Attorney, Agent, or Firm*—John F. McCabe

(57) ABSTRACT

A mechanical switch includes a pair of conducting contacts, metal located on and between the conducting contacts, a heater, and an electro-mechanical actuator. The heater is operable to apply heat that melts the metal. The electro-mechanical actuator is capable of moving one or both of the conducting contacts in a manner that causes the metal to either start physically bridging the conducting contacts or to stop physically bridging the conducting contacts.

14 Claims, 16 Drawing Sheets

MECHANICAL SWITCH WITH MELTING BRIDGE

BACKGROUND

1. Field of the Invention

The invention relates to mechanical switches and to methods of operating and making mechanical switches.

2. Discussion of the Related Art

This section introduces aspects that may be helpful to facilitating a better understanding of the inventions. Accordingly, the statements of this section are to be read in this light. The statements of this section are not to be understood as admissions about what is in the prior art or what is not in the prior art.

A mechanical switch is an electrical switch that has a portion that is moved during the transformation of the switch between the open-switch state or non-conducting state and the closed-switch state or conducting state. Typically, in the open-switch state, a high resistance gap separates two conducting contacts of the mechanical switch so that substantially no electrical current flows between the conducting contacts. Typically, in the closed-switch state, the conducting contacts physically contact each other so that an electrical current can flow between the contacts.

In some mechanical switches a significant closing force pushes the conducting contacts together in the closed-switch state. The closing force stabilizes the relative positions of the conducting contacts to mechanical vibrations and temperature variations in the closed-switch state. Such stabilization helps to ensure that mechanical vibrations and temperature changes of the switch will not substantially change its contact resistance in the closed state.

In other mechanical switches, a liquid mercury body connects two conducting contacts in the closed-state and does not connect the conducting contacts in the open-switch state. Due to its liquid form, the mercury body is an electrical connector whose electrical resistance is substantially insensitive to small mechanical vibrations of the mechanical switch.

BRIEF SUMMARY

Various embodiments provide mechanical switches in which the controllable conducting path includes an easily melted metal region. The easily melted metal region is melted during the transformation of the electrical switch between the open-switch and closed-switch states.

In one aspect, a mechanical switch includes a pair of conducting contacts, metal located on and between the conducting contacts, a heater, and an electro-mechanical actuator. The heater is operable to apply heat that melts the metal. The electro-mechanical actuator is capable of moving one or both of the conducting contacts in a manner that causes the metal to either start physically bridging the conducting contacts or to stop physically bridging the conducting contacts.

In another aspect, a method of operating a mechanical switch includes moving a first conducting contact towards a second conducting contact such that metal bridges the conducting contacts. The method also includes heating the metal, wherein the heating causes the metal to be melted when the moved contact has moved towards the other contact. The act of moving the first contact causes the mechanical switch to be in a conducting state. The conducting contacts are configured to carry current through the mechanical switch in the conducting state.

Some embodiments of the above method also include allowing the melted metal to solidify into a solid bridge that connects the conducting contacts. These embodiments may also include heating the solid bridge such that metal therein remelts and moving one or both of the conducting contacts such that the metal does not physically bridge the conducting contacts.

BRIEF DESCRIPTION OF THE DRAWINGS

In the Figures and text, like reference numerals indicate elements with similar structures and/or functions.

In the Figures, the relative dimensions of some features may be exaggerated to more clearly illustrate one or more of the structures therein.

Herein, various embodiments are described more fully by the Figures and the Detailed Description of Illustrative Embodiments. Nevertheless, the inventions may be embodied in various forms and are not limited to the embodiments described in the Figures and Detailed Description of Illustrative Embodiments.

DETAILED DESCRIPTION OF ILLUSTRATIVE EMBODIMENTS

Figure 1:
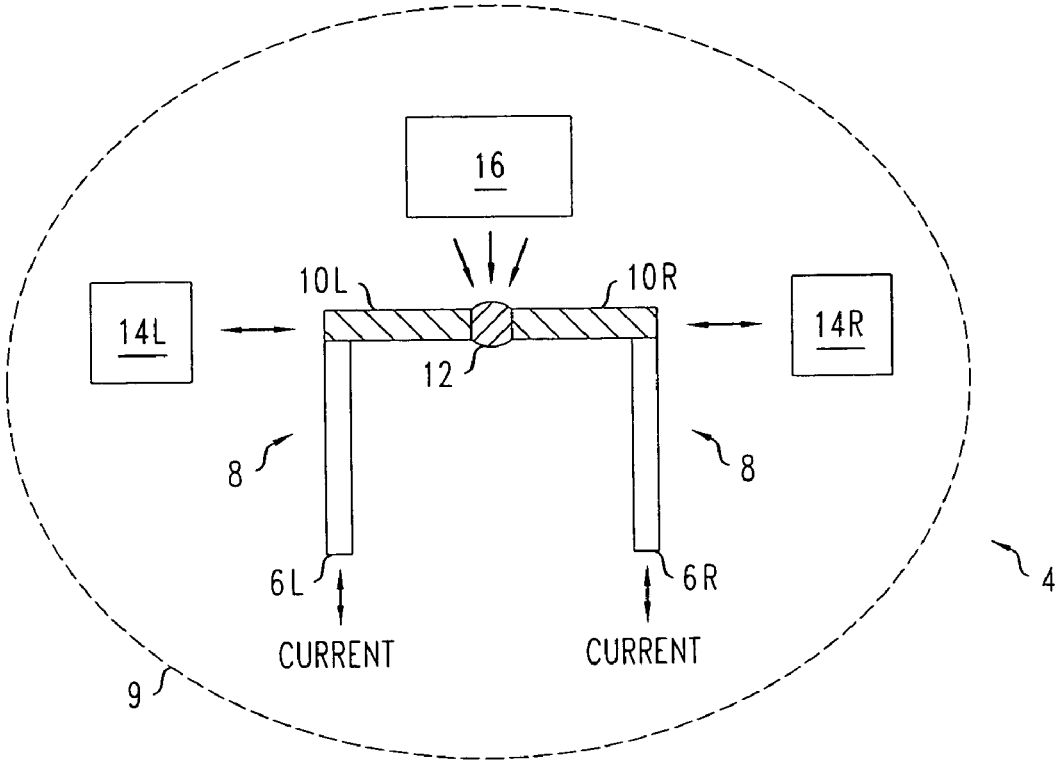
FIG. 1 is a top view that schematically illustrates a mechanical switch in a closed-switch state.
Figure 2:
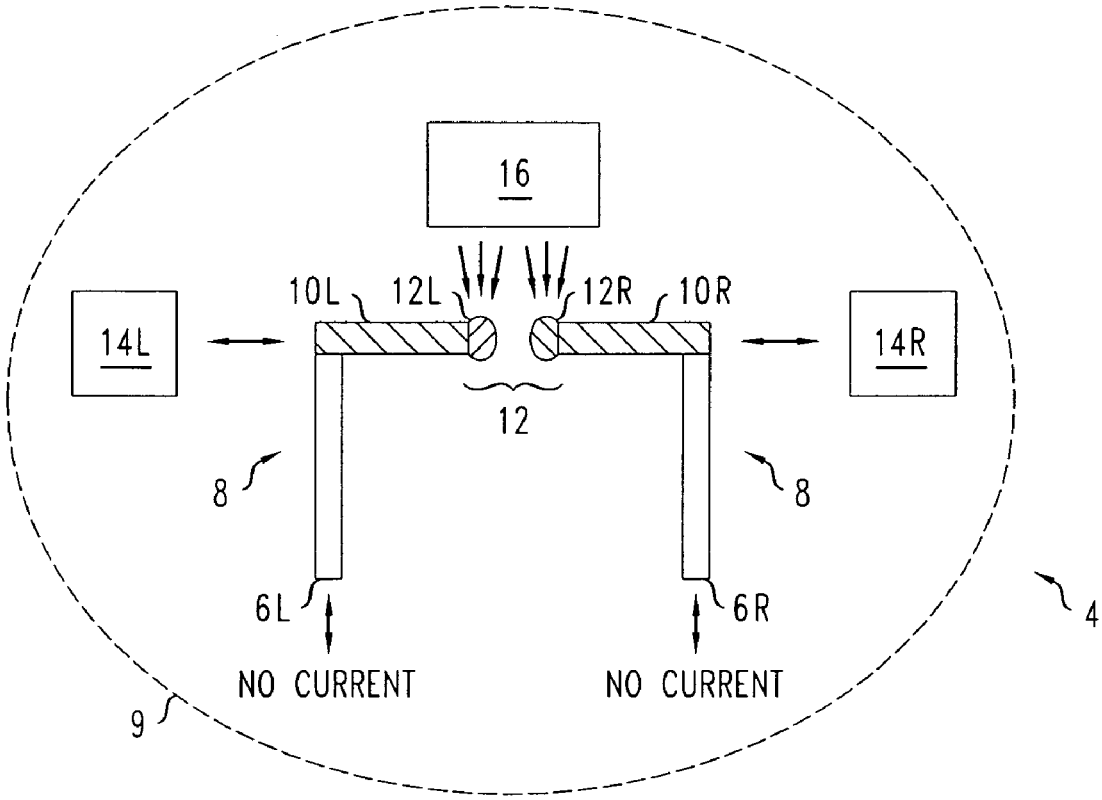
FIG. 2 is a top view that schematically illustrates the mechanical switch of FIG. 1 in an open-switch state.

FIGS. 1 and 2 illustrate the respective closed and open states of a mechanical switch 4. The mechanical switch 4 has two external ports 6L, 6R for connecting across an external circuit whose current state is controlled by the mechanical switch 4. The mechanically switch 4 includes a reversibly openable conduction path 8 for electrically connecting the two external ports 6L, 6R. The conduction path includes a pair of conducting contacts 10L, 10R and easily melted metal 12 located between and in contact with the conducting contacts 10L, 10R.

In the closed-switch state of FIG. 1, the easily melted metal 12 forms a solid metal bridge that physically connects the conducting contacts 10L, 10R together. The metal 12 of the solid metal bridge ensures that the conduction path 8 has a resistance that is both low and substantially insensitive to vibrations and temperature changes of the mechanical switch 4. In particular, the metal 12 of the solid metal bridge ensures that the connection between the conducting contacts 10L, 10R has a low and vibration-insensitive resistance in the closed-switch state. Also, the value and vibration and temperature insensitivity of this internal resistance is substantially insensitive to the size of any force pushing the conducting contacts 10L, 10R together. Indeed, there may be no force pushing together the conducting contacts 10L, 10R in the closed-switch state.

In the open-switch state of FIG. 2, the easily melted metal 12 is located between the conducting contacts 10L, 10R, but the easily melted metal 12 does not physically bridge the conducting contacts 10L, 10R. Instead, the easily melted metal 12 forms physically separated metal drops 12L, 12R, e.g., solid metal drops. In the open-switch state, one or more of the metal drops 12L, 12R is located on each conducting contact 10L, 10R.

Typically, the melting temperature of the easily melted metal 12 is higher than room temperature, i.e., 20 degrees Centigrade (° C.), and is lower than about 350° C. The easily melted metal 20 may be an elemental metal or a metal alloy. Exemplary suitable easily melted metals may include indium (In), tin (Sn), lead (Pb), gallium (Ga) and bismuth (Bi). Exemplary suitable metal alloys may include tin/copper (Sn/Cu), tin/silver (Sn/Ag), tin/gold (Sn/Au), tin/zinc (Sn/Zn), tin/lead (Sn/Pb), tin/bismuth (Sn/Bi), tin/indium (Sn/In). Exemplary other suitable metals and metal alloys may include conventional metals/metal alloys for solders that are used for bonding metals.

The mechanical switch 4 also includes one or more electro-mechanical actuators 14L, 14R that provide mechanical force (s), e.g., as indicated by arrows. The mechanical force(s) move one or both conducting contacts 10L, 10R. In particular, the applied force(s) reduce the distance between the conducting contacts 10L, 10R to close the mechanical switch 4 and increase the distance between the conducting contacts 10L, 10R to open the mechanical switch 4. Herein, an electro-mechanical actuator refers to a structure that is able to apply a mechanical force in response to being driven by an electrical current/voltage. Exemplary electro-mechanical actuators may include moving plate capacitors, electromagnets, piezoelectric materials, current-controlled thermally expandable structures.

In some embodiments of the mechanical switch 4, some motions of one or both of the conducting contacts 10L, 10R may be caused by mechanical relaxation of a spring or resilient bar rather than being generated by the electro-mechanical actuators 14L, 14R. For example, some such embodiments include one or more resilient bar(s) that are stressed by the opening or closing of the mechanical switch 4, i.e., during motion caused by the one or more electro-mechanical actuators 14L, 14R. Then, relaxation of the stressed resilient bar drives the movement needed to return the mechanical switch 4 to its original switch state.

The mechanical switch 4 also includes one or more variable heat sources 16 as schematically indicated in FIGS. 1 and 2. The one or more variable heat sources 16 are able to transfer heat to the easily melted metal 12, e.g., as shown schematically by arrows in FIGS. 1-2. The one or more variable heat sources 16 are able to produce a quantity of heat that is sufficient to melt the easily melted metal 12. One exemplary heat source 16 is an electrical circuit having resistive heating wires that are located near the conducting contacts 10L, 10R. Another example of a heat source includes a variable voltage source that is electrically connected across the conducting contacts 10L, 10R and is capable of generating a voltage sufficient to cause the melting of the metal bridge 12 of FIG. 1.

In some embodiments, the mechanical switch 4 is able to close only once.

In other embodiments, the mechanical switch 4 is operable to perform a series of transformations between the open-switch state and the closed-switch state in a substantially reversible manner. In some such embodiments, each transformation includes melting the metal 12 and then, solidifying the metal 12.

In various embodiments, the mechanical switch 4 may also be encapsulated in a hermetically sealed chamber 9. The chamber 9 may retain an inert atmosphere, e.g., of argon, around the mechanical switch 4 to impede corrosion thereof.

Since the metal 12 ensures the low resistance of the electrical contact between the metal contacts 10L, 10R, some embodiments of the mechanical switch 4 may not apply force (s) to the metal contacts 10L, 10R in either the closed-switch state or the open-switch state. In such embodiments, forces are applied only to make mechanical transformations between switch states. Thus, these embodiments of the mechanical switch 4 are latching switches.

Figure 3:
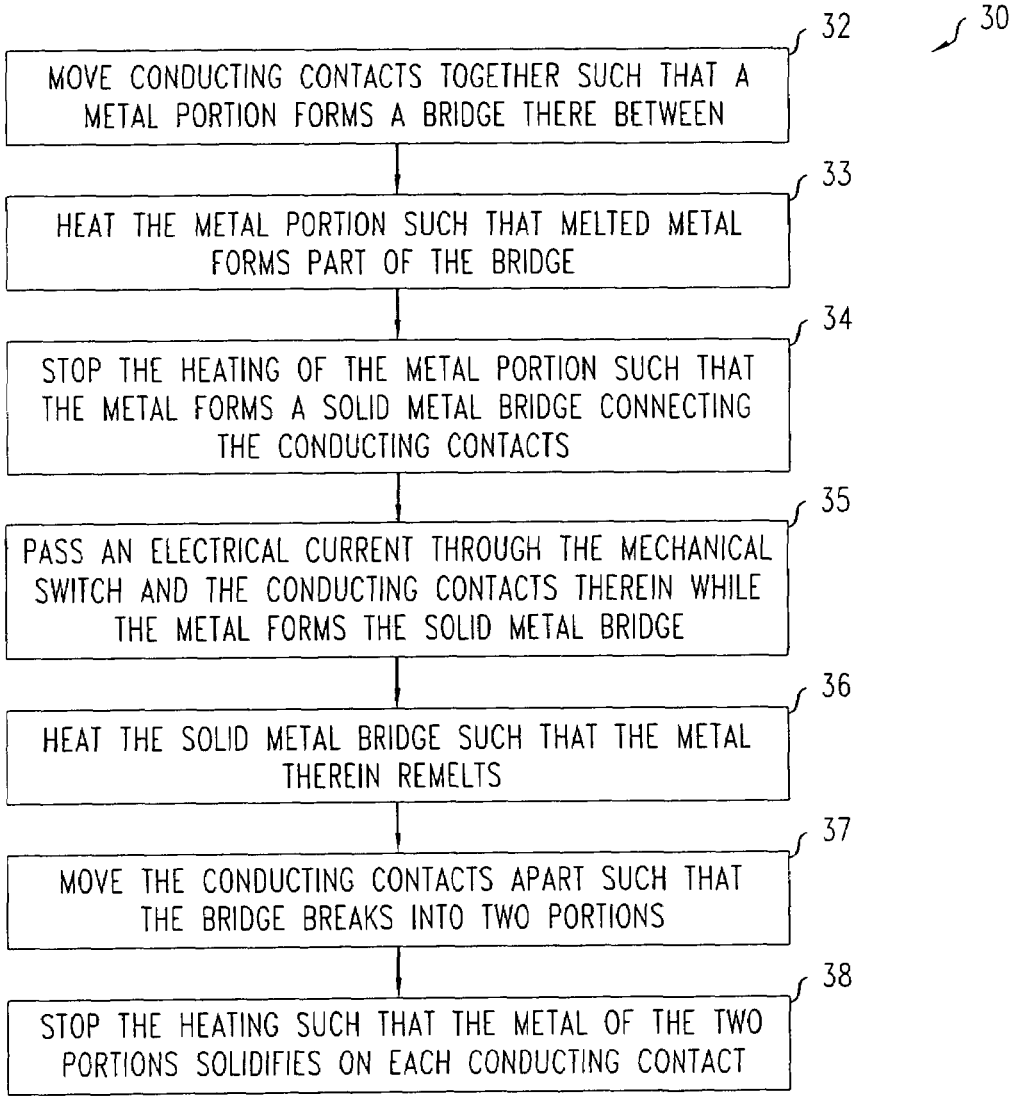
FIG. 3 is flow chart illustrating a method of operating a mechanical switch with an easily melted metal connector, e.g., the mechanical switch of FIGS. 1-2.

FIG. 3 illustrates a method 30 of operating a mechanical switch whose internal current path includes an easily melted metal portion, e.g., the mechanical switch 4 of FIGS. 1-2.

The method 30 includes moving a first conducting contact towards a second conducting contact such that the easily melted metal portion forms a metal bridge between the two conducting contacts (step 32). Due to the metal bridge, the mechanical switch is in the closed-switch state, wherein the current path through the mechanical switch includes the conducting contacts and the metal portion. The moving step results from applying mechanical force to one or both conducting contacts.

Such mechanical forces may be generated by various structures in different embodiments. In some embodiments, the forces are electrostatic and are generated by charging or discharging a capacitor. The capacitor has one or more moveable plates mechanically coupled to one or both conducting contacts. In other embodiments, the mechanical forces are generated electrically by adjusting a current level in a member that thermally expands or contracts in response to the adjustment. The member is mechanically coupled to one of the conducting contacts. In another embodiment, the mechanical forces are spring-like restoring forces generated by relaxing a spring or a resilient mechanical structure, or may even be magnetic forces.

The method 30 includes heating the easily melted metal portion such that melted metal thereof forms part of the physical bridge portion between the first conducting and second contacts (step 33). The heating typically involves raising the temperature of the metal to a temperature greater than room temperature. The metal preferably has a melting temperature that is lower than about 350° C. Due to the melted metal bridging the conducting contacts, the resistance of the current path between the conducting contacts is typically less sensitive to vibrations of the mechanical switch.

The heating may be generated by various methods in different embodiments. The heating may result from passing an electrical current directly through the metal portion such that resistive dissipation therein causes the melting. Alternatively, the heating may be generated by a separate heater. Such a heater may include resistive wire(s) near and in thermal contact with the easily melted metal portion. Then, passing an electrical current through the resistive wire(s) generates the heat to melt the easily melted metal portion.

The method 30 includes stopping the heating of the easily melted metal portion so that the metal solidifies to form a solid bridge that physically connects the conducting contacts (step 34).

The method 30 includes passing an electrical current through the mechanical switch and the conducting contacts therein while the metal portion forms a solid bridge there between (step 35). The electrical current is a current that the mechanical switch is designed to carry in the closed-switch state.

The method 30 includes heating the solid bridge such that metal therein remelts (step 36). Any of the heating methods described above with respect to step 33 may generate the heat that remelts the solid bridge.

The method 30 includes moving one or both of the conducting contacts such that the conducting contacts become farther apart (step 37). The moving is continued until the melted metal portion splits into separate portions, which no longer physically bridge the conducting contacts. Then, the current path through the mechanical switch is broken, i.e., the switch is in the open-switch state. The moving may be produced by any of the structures/methods already described with respect to above step 32.

The method 30 may include stopping the heating so that the metal refreezes to form physically separate metal drops on each conducting contact (step 38).

The method 30 may include sequentially repeating steps 32-38 a plurality of times to produce a sequence of closings and openings of the mechanical switch.

FIGS. 4A-4D, 5A-5C, 6A, and 6B illustrate micro-mechanical embodiments 40, 90, 40', 90' of the mechanical switch 4 illustrated by FIGS. 1-2. The micro-mechanical switches 40, 90, 40', 90' of FIGS. 4A-4D, 5A-5C, 6A, and 6B may also be operated according to the method 30 of FIG. 3.

Figure 4A:
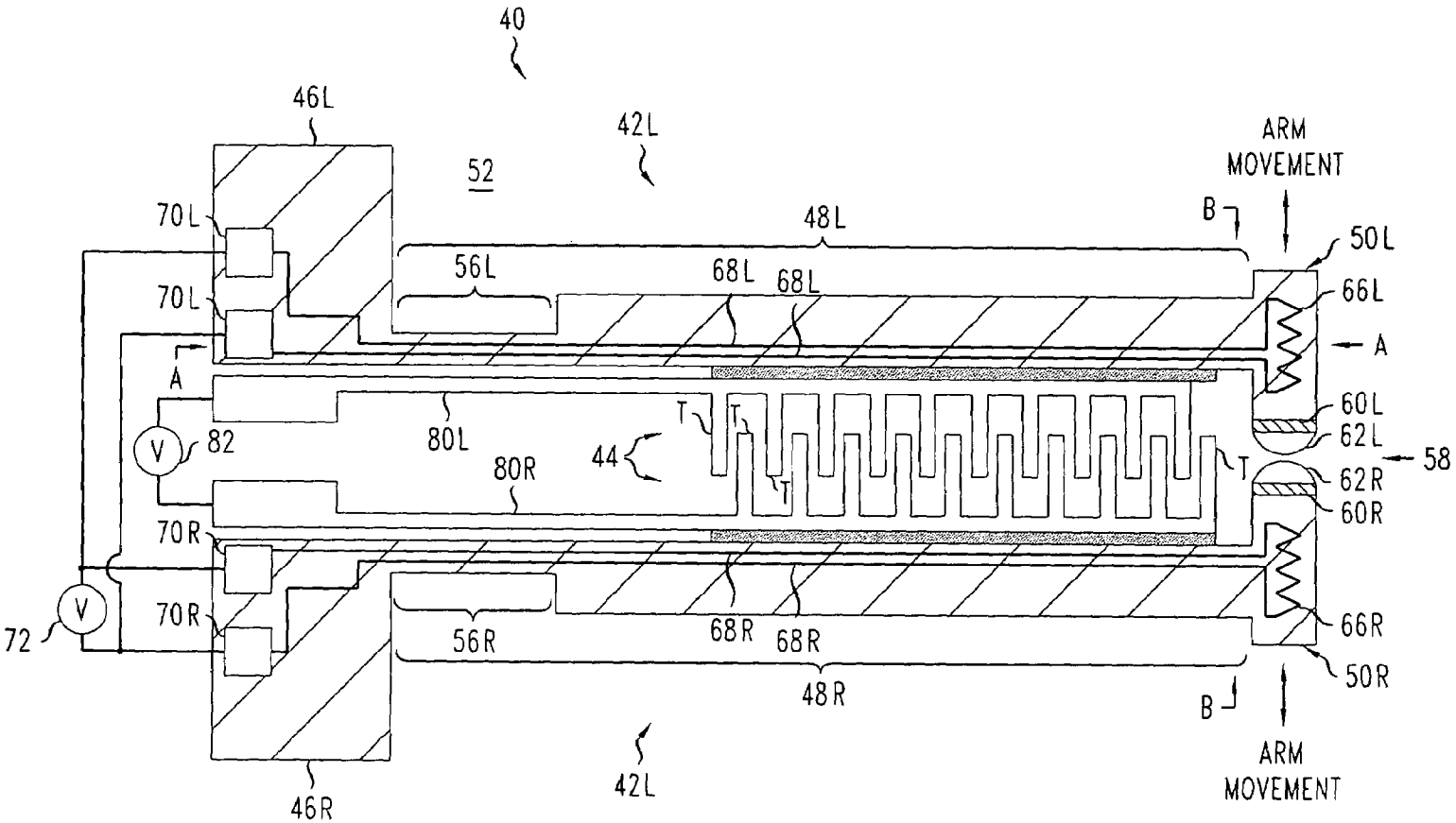
FIG. 4A is a top view of a micro-mechanical embodiment of the mechanical switch of FIGS. 1-2.

FIG. 4A shows a micro-mechanical switch 40 in the open-switch state. The micro-mechanical switch 40 uses electrostatic forces to transform between the open-switch state and closed-switch state. The micro-mechanical switch 40 includes symmetrically constructed left and right switch arms 42L, 42R and a comb-drive actuator 44 located between the switch arms 42L, 42R.

The switch arms 42L, 42R include support portions 46L, 46R, elongated arms 48L, 48R, and end portions 50L, 50R. The support portions 46L, 46R physically fix proximal ends of the switch arms 42L, 42R to a top surface of a support substrate 52. The elongated arms 48L, 48R rest above the top surface of the support substrate 52 and are able to laterally flex parallel to the top surface about thinner regions 56L, 56R. Such lateral movement or flexing of the elongated arms 48L, 48R can open or close a gap 58 between the left and right the end portions 50L, 50R of the switch arms 42L, 42R. The left and right end portions 50L, 50R include metal contacts 60L, 60R and at least one easily melted metal droplet 62L, 62R on each metal contact 60L, 60R. Each switch arm 42L, 42R includes a part of an electrically conducting path (not shown) that is configured to carry an electrical current between external electrical ports (not shown) on the two support portions 46L, 46R via the metal contacts 60L, 60R in the closed-switch state.

When the metal contacts 60L, 60R are near or in contact, the metal droplet(s) 62L, 62R can be melted to form a metal bridge between the metal contacts 60L, 60R. In the closed-switch state, a solid metal bridge forms part of the electrical conduction path between the metal contacts 60L, 60R. To ease the formation of a one-piece metal bridge, the metal droplet(s) 62L, 62R are formed of a metal or a metal alloy that has a low melting temperature, e.g., a melting temperature of less than about 350° C. The metal or metal alloy is however, typically a solid at room temperature. The metal or metal alloy can have any of the compositions already described for the easily melted metal 12 of FIGS. 1-2.

For controlling the physical solid/liquid state of the metal droplet(s) 62L, 62R, the left and right switch arms 42L, 42R include resistive heater wires 66L, 66R, which are located near the metal contacts 60L, 60R. The resistive heater wires 66L, 66R electrically connect via conducting lead lines 68L, 68R to conducting connection pads 70L, 70R, which are located in the support portions 46L, 46R. The resistive heating wires 66L, 66R may have the same composition and a smaller cross section than the conducting lead lines 68L, 68R so that a larger percentage of current-produced heat dissipation occurs in the distal end portions 50L, 50R that are located adjacent metal droplet(s) 62L, 62R rather than in the remainders of the switch arms 42L, 42R. The metal connection pads 70L, 70R electrically connect across a variable voltage source 72. The variable voltage source is able to generate a voltage suitable to create a current that dissipates enough heat in the resistive heating wires 66L, 66R to melt the nearby metal droplet(s) 62L, 62R.

The comb-drive actuator 44 is a capacitor that has metallic left and right plates 80L, 80R, which are able to move relatively to each other. The left and right plates 80L, 80R have arrays of teeth, T, that inter-digitate to increase the area of the plates 80L, 80R. The plates 80L, 80R of the comb-drive actuator 44 either abut against the inner side surfaces of the switch arms 42L, 42R or are rigidly fixed to said side surfaces. For that reason, motion of the plates 80L, 80R causes lateral movement or bending of the switch arms 42L, 42R and thus, can transform the mechanical switch 40 between the open-switch and closed switch states. In particular, electrostatic forces between the plates 80L, 80R control such transformations. The left and right plates 80L, 80R electrically connect across a variable voltage source 82 that controls the voltage and electrostatic forces between the plates 80L, 80R.

Figure 4B:
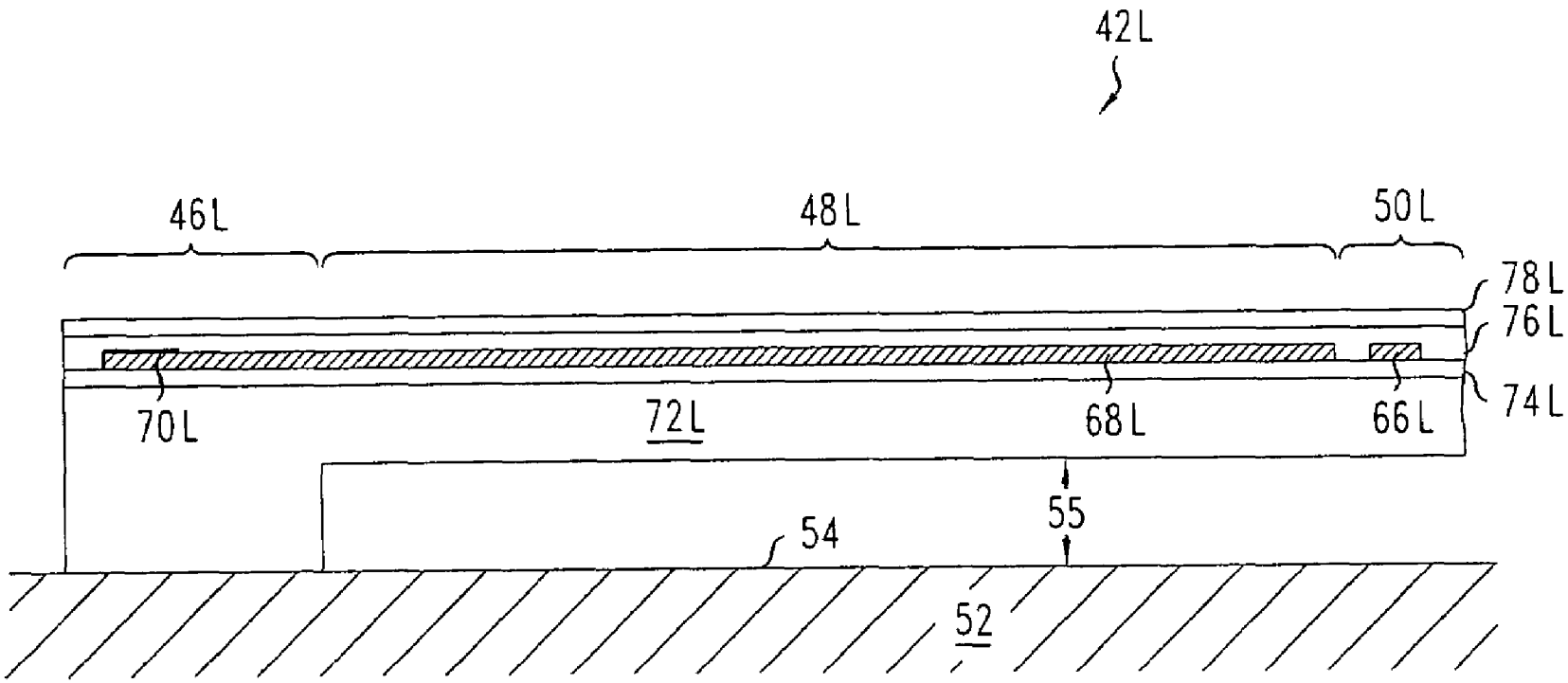
FIG. 4B is a cross-sectional view along a vertical plane through one switch arm of one embodiment of the micro-mechanical switch of FIG. 4A.
Figure 4C:
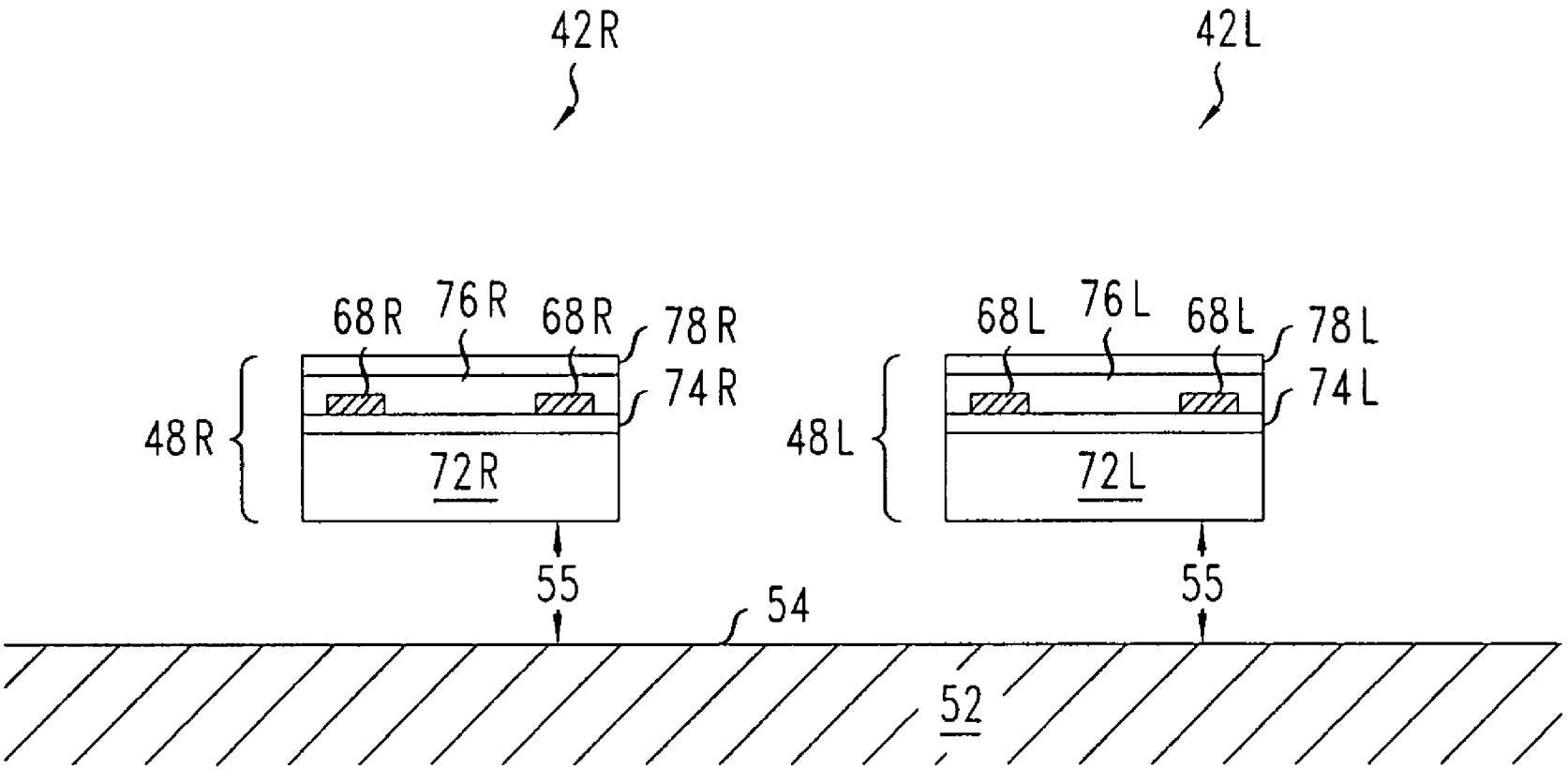
FIG. 4C is a cross-sectional view along a plane transverse to the axes of the switch arms in the embodiment of the micro-mechanical switch of FIGS. 4A-4B.

FIGS. 4B and 4C illustrate one embodiment for the micro-mechanical switch 40 along respective lines A-A and B-B of FIG. 4A. In this embodiment, the vertical structure of the switch arms 42R, 42L includes bottom support portions 72L, 72R; first dielectric layers 74L, 74R; conducting lead lines 68L, 68R; second dielectric layers 76L, 76R; and optionally top conducting layers 78L, 78R. The support portions 72L, 72R provide physical support for the switch arms 42L, 42R, but can flex to enable opening and closing of the micro-mechanical switch 40. The support portions 72L, 72R are located above the top surface 54 of the support substrate 52. In particular, an empty gap 55 separates the elongated arms 48L, 48R from the top surface 54. The support portions 72L, 72R are fabricated of a conventional micro-electronics support material such as crystalline silicon. The dielectric layers 74L, 76L, 74R, 76R provide electrical insulation between the metal lead lines 68L, 68R and the support portions 72L, 72R and top conducting layers 78L, 78R. The top conducting layers 78L, 78R are, e.g., metal layers or metal multi-layers and can form the electrical conduction paths between external ports (not shown) and the metal contacts 60L, 60R shown in FIG. 4A.

Figure 4D:
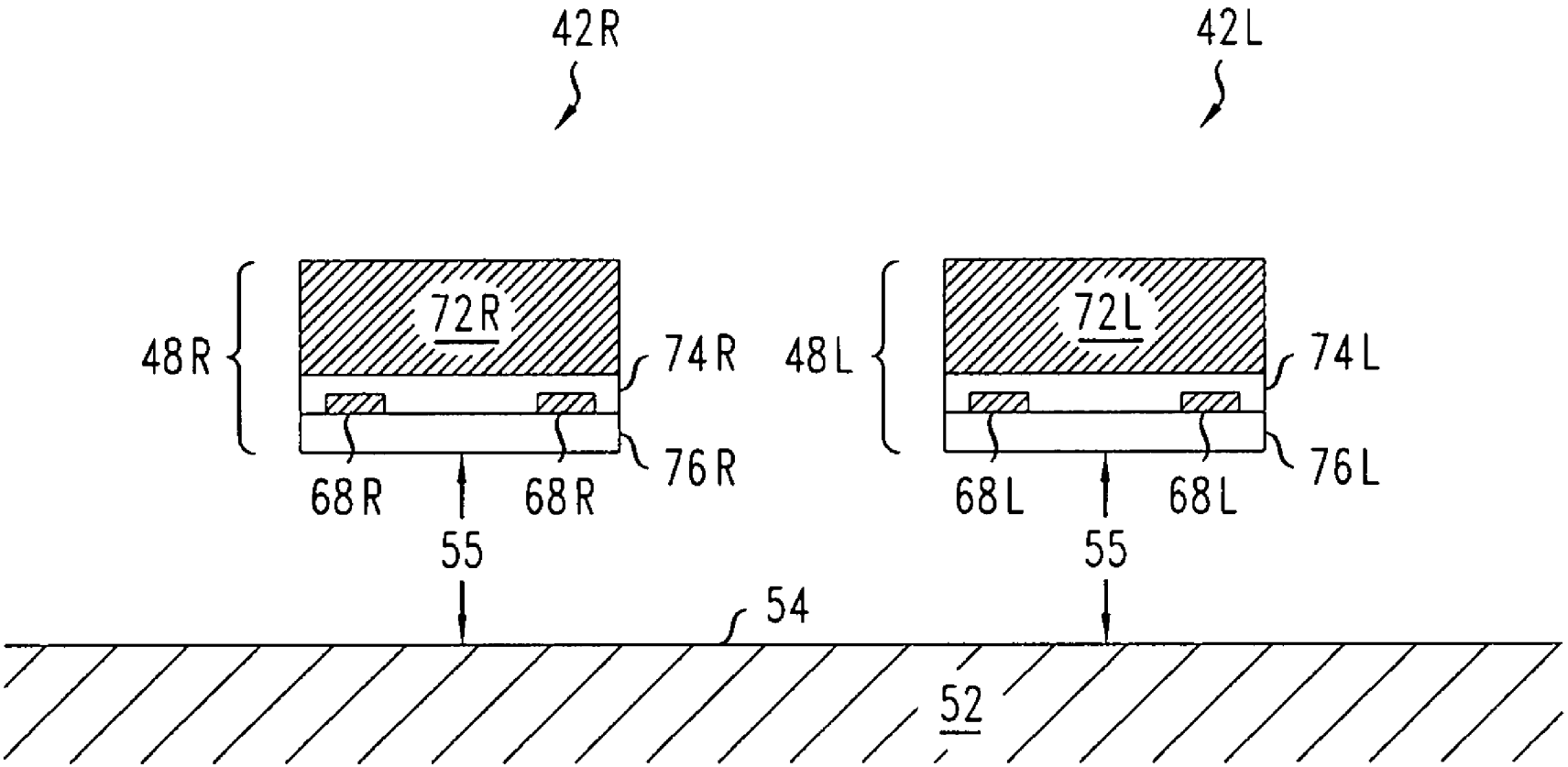
FIG. 4D is a cross-sectional view along a plane transverse to the axes of the switch arms in another embodiment of the micro-mechanical switch of FIG. 4A.

FIG. 4D illustrates another embodiment for the micro-mechanical switch 40 along line B-B of FIG. 4A. In this embodiment, the vertical structure of the elongated arms 48L, 48R of the switch arms 42R, 42L again includes support portions 72L, 72R; first dielectric layers 74L, 74R; conducting lead lines 68L, 68R; and second dielectric layers 76L, 76R. The vertical order of the layers is however, inverted between the embodiments of the switch arms of FIGS. 4C and 4D. In particular, the support portions 72L, 72R a located on top of the other portions in the elongated arms 48L, 48R of FIG. 4D. Such an inverted ordering of the layers facilitates fabrication of the support portions 72L, 72R, from an electroplated metal, e.g., nickel, as described below. In such embodiments, the support portions 72L, 72R can form the electrical conduction path between external ports and the metal contacts 60L, 60R shown in FIG. 4A.

In other embodiments of the micro-mechanical switch 40, one of the support arms 42L, 42R is rigidly fixed to the support substrate 52 along its whole length so that the movement or bending of the remaining support arm 42R, 42L alone occurs during the opening and closing the micro-mechanical switch 40. In one such embodiment, the region 56R also has the same thickness and width as the remainder of the elongated arm 48R. In the same embodiment, the gap 55 below the right elongated arm 48R in FIG. 4C is filled by a vertical extension of the support portion 72R and/or a raised portion of the support substrate 52. Such modifications can make the right switch arm 42R immobile along its entire length.

Figure 5A:
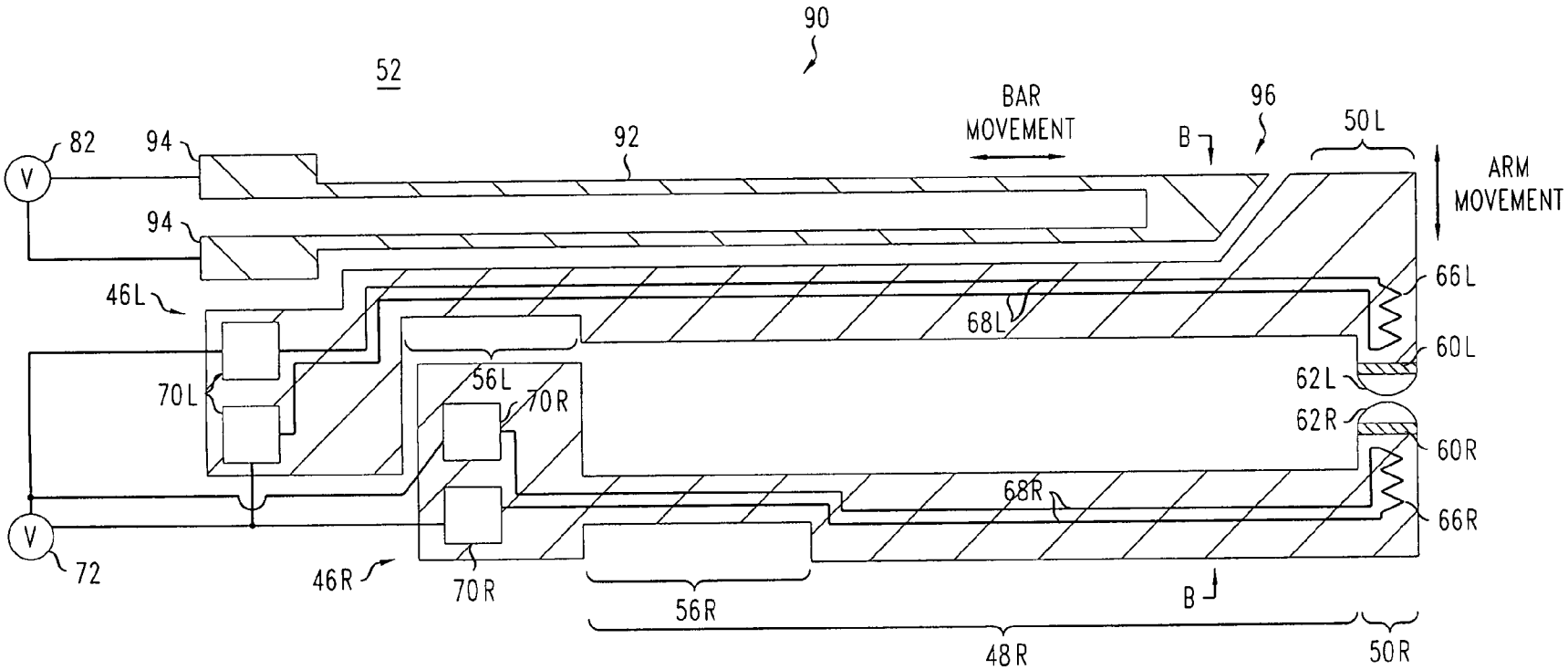
FIG. 5A is a top view of another micro-mechanical embodiment of the mechanical switch of FIGS. 1-2.

FIG. 5A shows a second micro-mechanical embodiment 90 of the mechanical switch 10 of FIGS. 1-2. The micro-mechanical switch 90 includes asymmetric left and right switch arms 42L, 42R and a U-shaped metal bar 92. In the micro-mechanical switch 90, thermal expansion and/or contraction of a structural member enables a transformation between the open-switch and closed-switch states.

The switch arms 42L, 42R include support portions 46L, 46R; elongated arms 48L, 48R; end portions 50L, 50R; thin regions 56L, 56R; metal contacts 60L, 60R; metal droplet(s) 62L, 62R; resistive heater wires 66L, 66R; conducting lead lines 68L, 68R; and conducting connection pads 70L, 70R. These elements have substantially the constructions and functions already described for the like-numbered elements of the micro-mechanical switch 40 of FIG. 4A. The variable voltage source 72 electrical connects across the connection pads 70L, 70R and is able to apply a voltage to cause heat generation in the resistive heating wires 66L, 66R that is sufficient to melt the metal droplet(s) 62L, 62R. Such melting allows a transformation between separate droplet(s) 62L, 62R, i.e., in the open-switch state, and a single metal bridge (not shown) that connects the metal contacts 60L, 60R, i.e., in the closed-switch state.

The U-shaped metal bar 92 has proximal ends 94 that are rigidly fixed to the top surface of the support substrate 52 and has a distal end 96 that can abut against or be rigidly fixed to the end portion 50L of the left switch arm 42L. Except for the proximal ends 94, the U-shaped bar 92 is separated from the top surface 54 of the support substrate 52 by an empty gap so that the U-shaped bar 92 is free to expand along its length in response to being electrically heated. The proximal ends 94 of the U-shaped bar 92 electrically connect across a variable voltage source 82.

The U-shaped bar 92 functions as an electro-mechanical actuator for the micro-mechanical switch 90 when operated by the variable voltage source 82. In particular, the variable voltage source 82 is able to drive a current through the U-shaped bar 92 that causes thermal changes to the length of the U-shaped bar 92. Such current-induced length expansions, move of the distal end 96 of the U-shaped bar 92 against the end portion 50L of the left switch arm 42L thereby causing the end portion 50L to rotate or move toward the right end portion 50R of the right switch arm 42R. Such a rotation or motion is sufficient to reduce the gap 58 between the metal contacts 60L, 60R so that the micro-mechanical switch 90 is transformed to the closed-switch state. That is, the electrically-controlled thermal expansion of the U-shaped bar 92 produces the mechanical force for closing the micro-mechanical switch 90. In some embodiments, thermal contraction of the U-shaped bar 92 is also able to provide the mechanical force for transforming the micro-mechanical switch 90 to the open-switch state, i.e., when the distal end 96 is rigidly fixed to the end portion 50L.

Figure 5B:
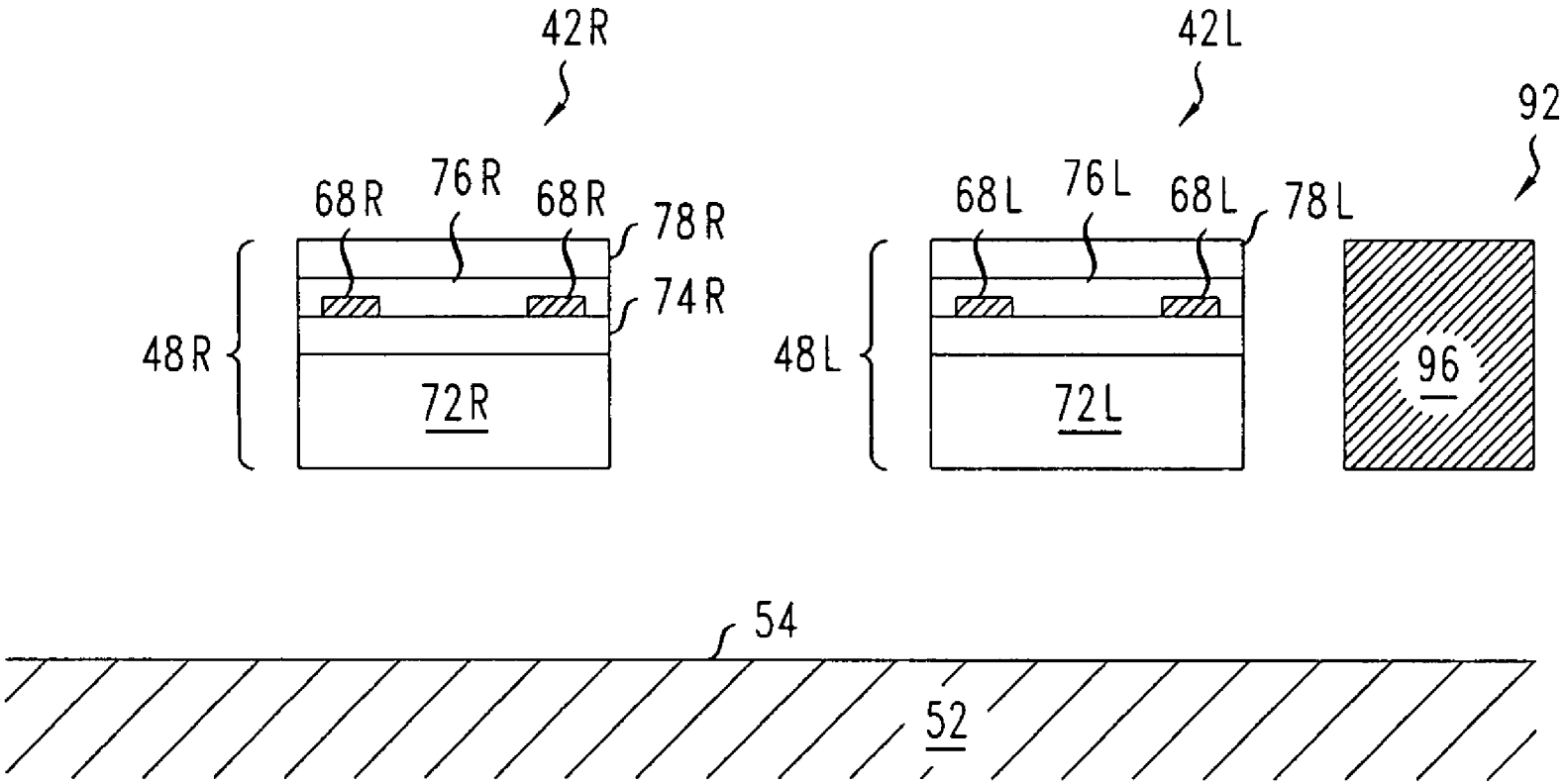
FIG. 5B is a cross-sectional view along a plane transverse to the axes of the switch arms of one embodiment of the micro-mechanical switch of FIG. 5A.

FIG. 5B illustrates one embodiment of a vertical structure for the switch arms 42L, 42R of the micro-mechanical switch 90 along line B-B of FIG. 5A. In this embodiment, the vertical structure of the elongated arms 48L, 48R includes bottom support portions 72L, 72R; first dielectric layers 74L, 74R; conducting lead lines 68L, 68R; second dielectric layers 76L, 76R; and optionally top conducting layers 78L, 78R. These elements have the same constructions and functions as like-numbered elements of the embodiment of the micro-mechanical switch 40 as already described with respect to above FIGS. 4B-4C. This vertical structure may be advantageous for forming the support portions 72L, 72R in microelectronics materials such as crystalline silicon.

Figure 5C:
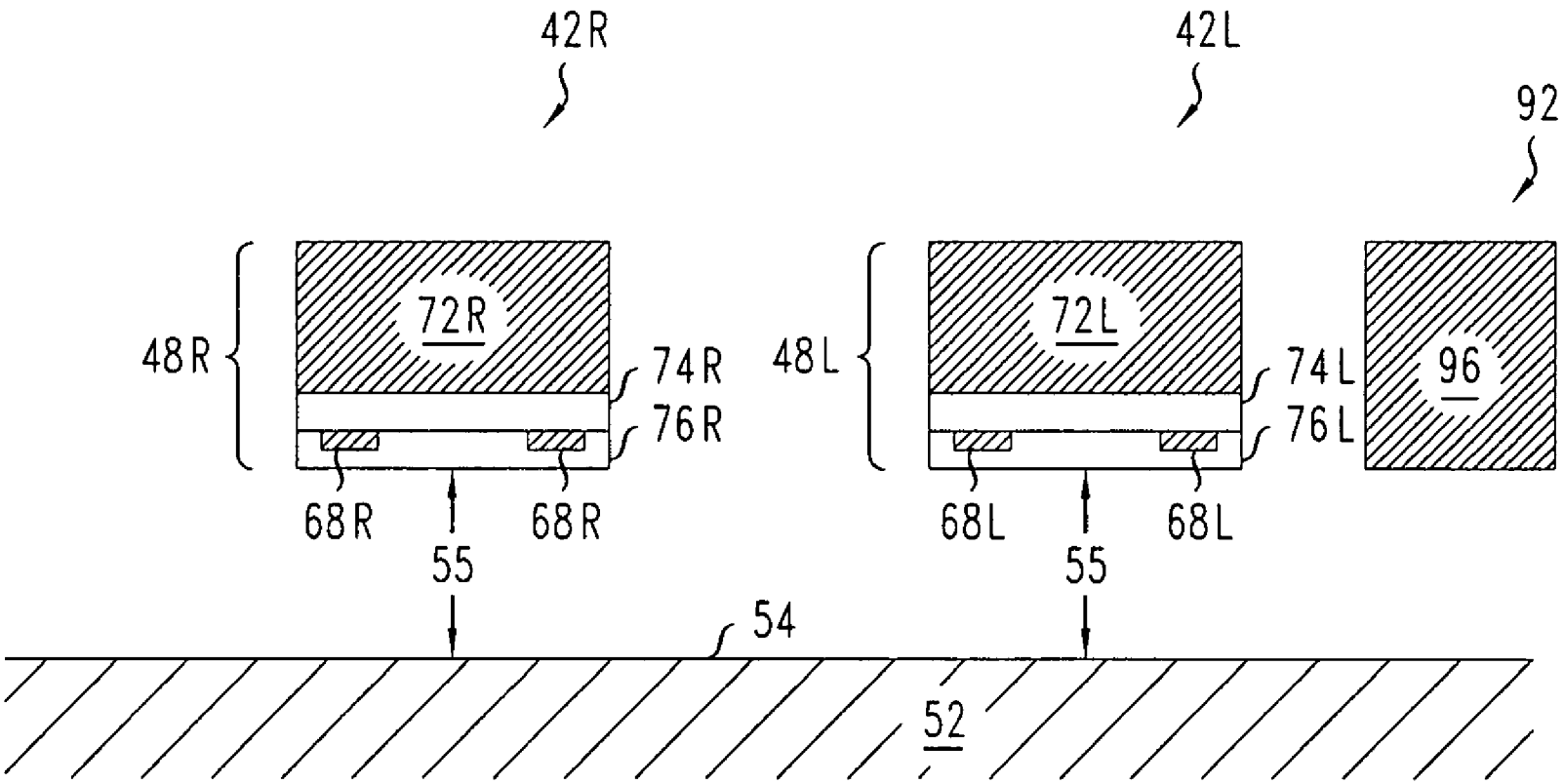
FIG. 5C is a cross-sectional view along a plane transverse to the axes of the switch arms of another embodiment of the micro-mechanical switch of FIG. 5A.

FIG. 5C illustrates another embodiment of the vertical structure of the switch arms 42L, 42R of the micro-mechanical switch 90 along line B-B of FIG. 5A. In this embodiment, the vertical structure of the elongated arms 48L, 48R includes top support portions 72L, 72R; first dielectric layers 74L, 74R; conducting lead lines 68L, 68R; and second dielectric layers 76L, 76R. These elements may have the same constructions and functions as like-numbered elements of the embodiment of the micro-mechanical switch 40 as already described with respect to above FIG. 4D. This vertical structure can be advantageous for forming the top support portions 72L, 72R in microelectronics materials such as electroplated metals, e.g., electroplated Ni as described below.

In other embodiments of the micro-mechanical switch 90, the right switch arm 42R may be rigidly fixed to the support substrate 52 so that movement or bending of the left support arm 42L alone is involved in the opening and closing of the micro-mechanical switch 90. For example, the gap 55 of FIG. 5B or 5C may be absent below the right elongated arm 48R due a raised area of the support substrate 52 there under and/or due to a thickened dielectric layer 76R.

Figure 6A:
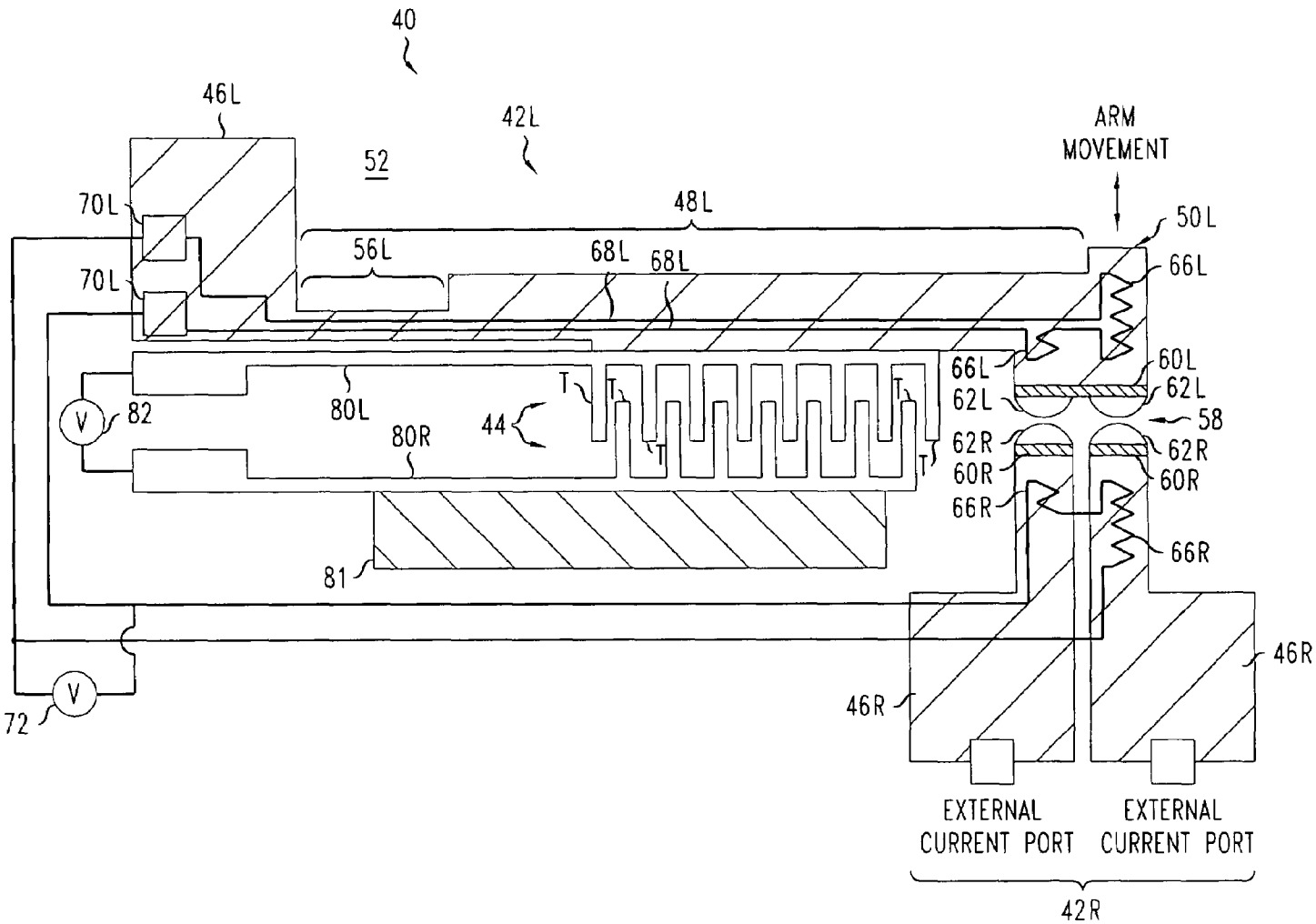
FIGS. 6A-6B are top views of other micro-mechanical embodiments of the mechanical switch of FIGS. 1-2 that may have short electrical conduction paths.
Figure 6B:
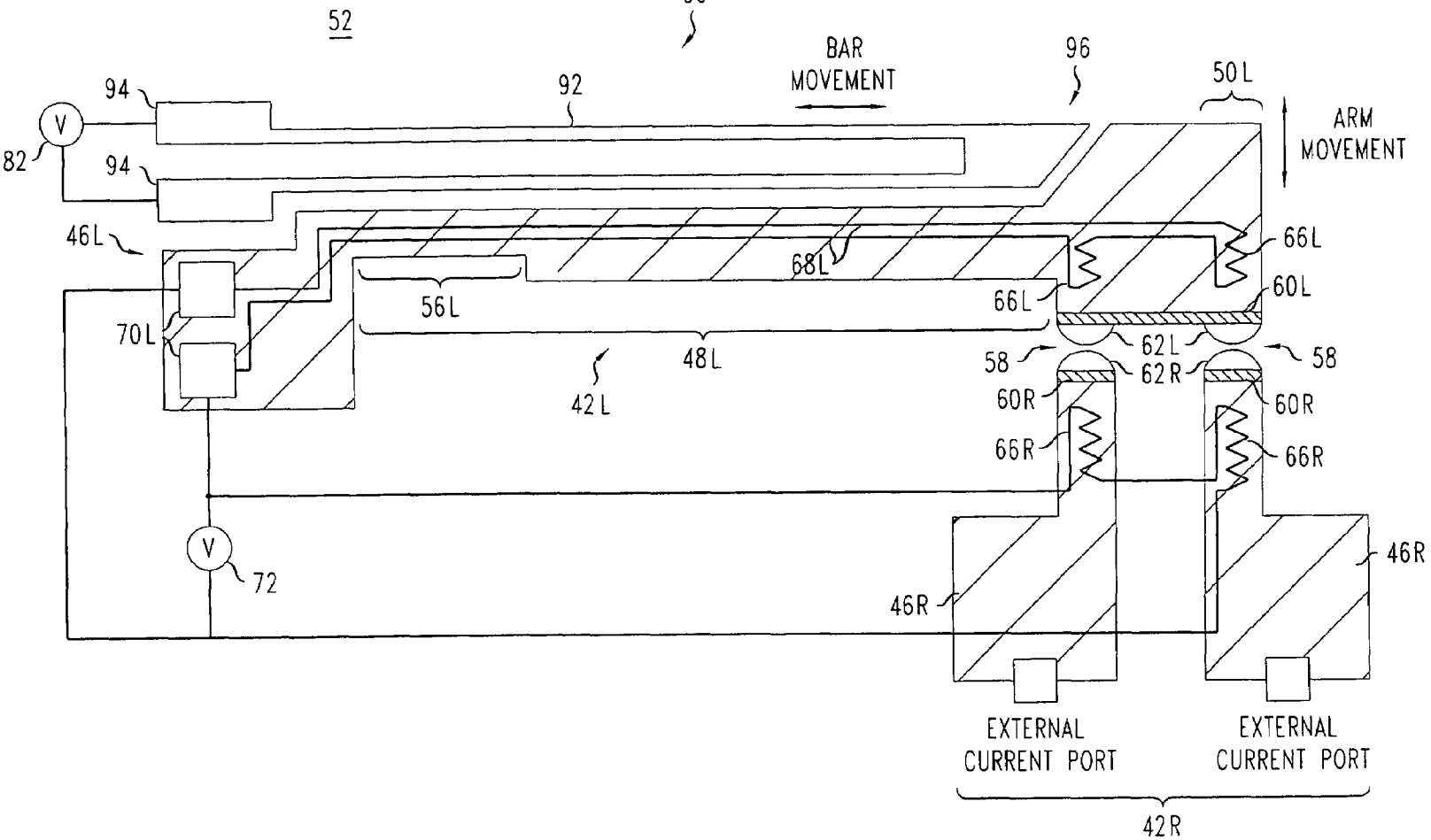

FIGS. 6A and 6B show alternate embodiments 40', 90' of the mechanical switch 4 of FIGS. 1 and 2 in which the switch arm 42L is mobile with respect to support substrate 52 and the right switch structure 42R is immobile with respect to support substrate 52.

FIG. 6A illustrates a mechanical switch 40' that is similar to the mechanical switch 40 of FIG. 4A. In the mechanical switch 40' the switch arm 42L and capacitor plate 80L are partially mobile with respect to the support substrate 52, and the switch structure 42R and the capacitor plate 80R are immobile with respect to the support substrate 52. A raised structure 81 may fix the right plate 80R of the comb-drive actuator 44 to the support substrate 52. In the mobile switch arm 42L of FIG. 6A, the metal contact 60L of the mechanical switch 40 of FIG. 4A has been replaced by a metal electrical jumper 60L. The metal electrical jumper 60L has a separate easily melted metal droplet 62L on each of its two ends. The elongated arm 48L of the left switch arm 42L of the mechanical switch 40' does not carry the externally applied current that the mechanical switch 40' controls. Instead, the immobile right switch structure 42R has two separate electrical conduction paths for carrying such an externally applied current. Each of these electrical conduction paths ends on one of the two metal contacts 60R and associated easily melted metal droplets 62R. The other numbered elements/features of the mechanical switches 40, 40' of FIGS. 4A and 6A have similar constructions and functions.

Referring still to FIG. 6A, the mechanical switch 40' closes when the mobile left arm 42L moves the ends of the metal electrical jumper 60L towards the metal contacts 60R on the right switch structure 42R. The metal droplets 62L contact the corresponding metal droplets 62R at the ends of the two conduction paths in the right switch structure 42R thereby electrically connecting said conduction paths. Since these conduction paths do not extend the length of a long switch arm, the mechanical switch 40' of FIG. 6A can have a smaller internal resistance than the mechanical switch 40 of FIG. 4A when similar materials form corresponding structures of both mechanical switches 40, 40'.

FIG. 6B illustrates a mechanical switch 90' that is similar to the mechanical switch 90 of FIG. 5A. In the mechanical switch 90' the left switch arm 42L and U-shaped bar 92 are partially mobile with respect to the support substrate 52, and the right switch structure 42R is immobile with respect to the support substrate 52. In the mobile left switch arm 42L of FIG. 6B, the metal contact 60L of FIG. 5A has been replaced by a metal electrical jumper 60L. The metal electrical jumper 60L has a separate easily melted metal droplet 62L on each of its two ends. The elongated arm 48L of the left switch arm 42L does not carry the externally applied current that the mechanical switch 90' controls. Instead, the immobile right switch structure 42R has two separate electrical conduction paths for carrying such an externally applied current. Each of the electrical conduction paths ends on one of the two metal contacts 60R and associated easily melted metal droplets 62R. The other numbered elements/features of the mechanical switches 90, 90' of FIGS. 5A and 6B have similar constructions and functions.

Referring still to FIG. 6B, the mechanical switch 90' closes when the mobile left arm 42L moves the ends of the metal electrical jumper 60L towards the metal contacts 62R on the right switch structure 42R. The metal droplets 62L contact the corresponding metal droplets 62R at the ends of the conduction paths in the right switch structure 42R. Since these conduction paths do not extend the length of a long switch arm, the mechanical switch 90' can have a smaller internal resistance than the mechanical switch 90 of FIG. 5A when similar materials make up corresponding structures of both mechanical switches 90, 90'.

Other micro-mechanical embodiments of the mechanical switch 4 of FIGS. 1 and 2 may be similar to the micro-mechanical switches 40, 90, 40', 90' of FIGS. 4A-4D, 5A-5C, 6A and 6B except that these other embodiments have less electrical heater wires 66L, 66R for melting the metal droplets 62L, 62R. For example, such electrical heater wires may be located only in the left switch structure 42L or only in the right switch structure 42R in said other embodiments. Then, conduction across structural elements of these other mechanical switches would be used to melt the metal droplet(s) on the remaining right or left side of said mechanical switches. Similarly, the other embodiments, which are similar to the mechanical switches 40', 90' of FIGS. 6A-6B, may have a resistive heater wire 66L, 66R near only one of the metal droplets 62L, 62R thereby relying on conduction within the left side and/or right side of the mechanical switch and/or relying on conduction between the left side and right side to melt the remaining metal droplet(s) 62L, 62R.

Figure 7:
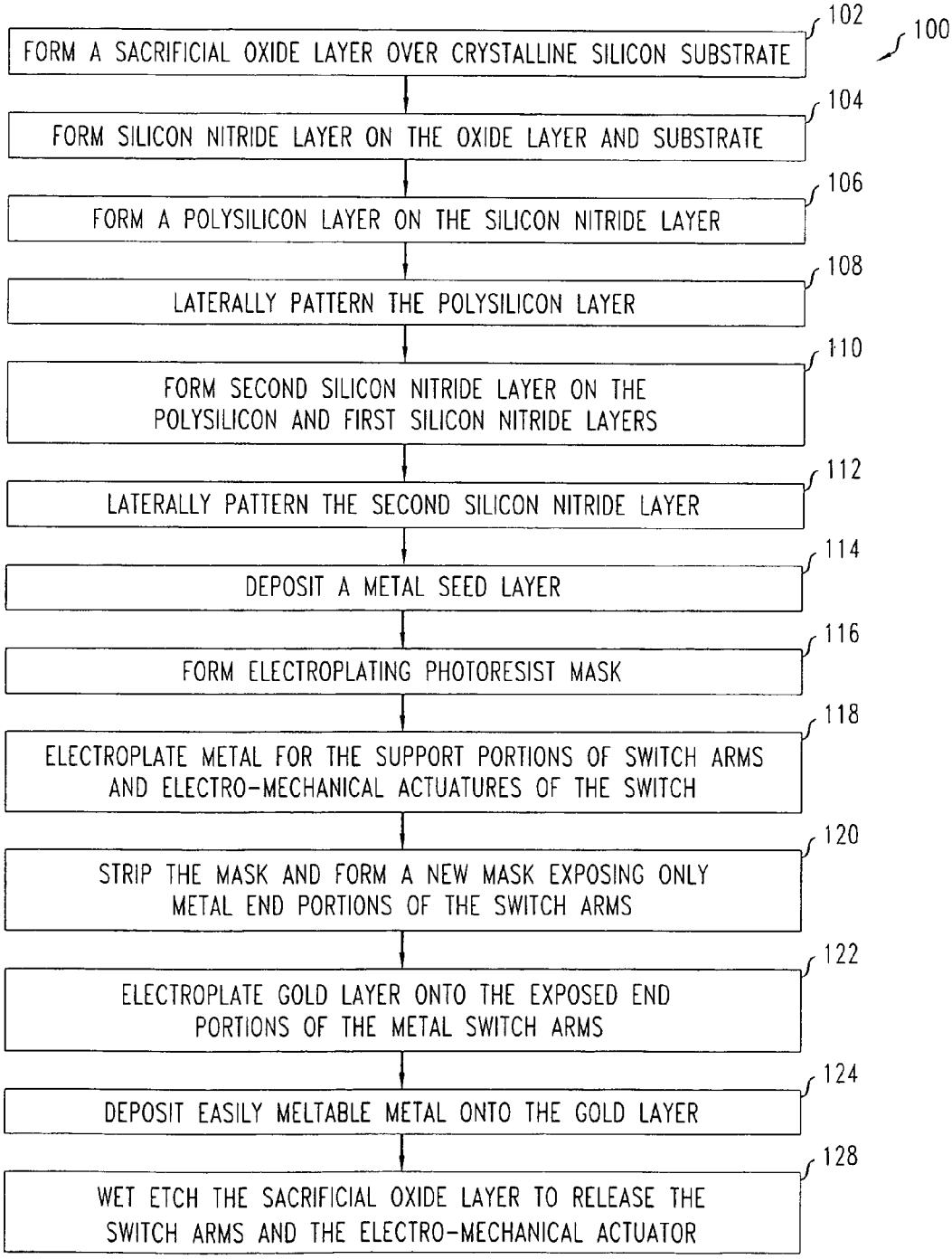
FIG. 7 is a flow chart illustrating a process for fabricating micro-mechanical switches, e.g., embodiments of the micro-mechanical switches of FIGS. 4A, 4D, 5A, 5C, 6A, and 6B.

FIG. 7 illustrates a method 100 for manufacturing various micro-mechanical switches, e.g., embodiments of the micro-mechanical switches 40, 90, 40', 90' as shown in FIGS. 4A and 4D, FIGS. 5A and 5C, FIG. 6A, and FIG. 6B. The method 100 produces intermediate structures 142, 152, 160 shown in FIGS. 8-10.

The method 100 includes forming a sacrificial oxide layer 132 over a selected part of the top surface of a crystalline silicon wafer substrate 130 (step 102). The formation of the sacrificial oxide layer 132 may involve, e.g., growing a layer of phosphosilicate to a thickness to about 0.5 or more micrometers (μm) via a conventional process. The sacrificial oxide layer 132 may be formed on another dielectric isolation layer, which is itself located on the silicon wafer substrate 130. Exemplary dielectric isolation layers include, e.g., layers of about 2 μm to about 5 μm of silicon nitride or silicon dioxide. The formation of the sacrificial oxide layer 132 also includes patterning the sacrificial oxide under the control of a conventional mask to produce a sacrificial oxide layer 132 with desired lateral dimensions. The patterned sacrificial oxide layer 132 will be removed later to enable the switch arms to flex laterally.

The method 100 includes performing a conventional deposition process to form a silicon nitride layer 134 on part of the patterned sacrificial oxide layer 132 and a selected part of the top surface of the support substrate 130 (step 104). The silicon nitride layer 132 may have a thickness of about 0.35 μm or more.

The method 100 includes forming a polysilicon layer 136 on the silicon nitride layer 134 by any conventional process known to those of skill in the art (step 106). The polysilicon layer 136 may have a thickness of about 0.7 μm or more and may be heavily n-type or p-type doped by conventional processes know to those of skill in the art to increase its conductivity.

The method 100 includes laterally patterning the polysilicon layer 136 under the control of a mask (step 108). The patterning may involve performing a conventional reactive ion etch (RIE) to remove undesired polysilicon. The mask may be formed of a conventional photoresist via a lithographic process. The patterning step includes removing the mask after the polysilicon layer 136 has been patterned.

The patterning produces the resistive heater wires 66L, 66R; conducting lead lines 68L, 68R; and conducting connection pads 70L, 70R of FIGS. 4A, 5A, 6A, and 6B. The patterning may also produce connection pads for carrying the switched current in the switch arms 42R, 42L.

The method 100 includes forming a second silicon nitride layer 138 on the patterned polysilicon layer 136 and the exposed underlying silicon nitride (step 110). This second silicon nitride layer 138 may have a thickness of about 0.35 μm or more.

The method 100 includes laterally patterning the second silicon nitride layer 138 under the control of a mask, e.g., a photoresist mask (step 112). The patterning may involve performing a RIE to remove both silicon nitride layers in selected areas. The patterning completes, e.g., the formation of the insulating dielectric layers 74L, 74R, 76L, 76R as shown in FIGS. 4D and 5C. The patterning may also expose areas for forming electrical connection pad for the metal support portions 72L, 72R of FIGS. 4D and 5C. The mask may be produced by a conventional lithographic process known to those of skill in the art. The patterning step 112 includes removing the mask via a conventional stripping process after the silicon nitride has been patterned.

Figure 8:
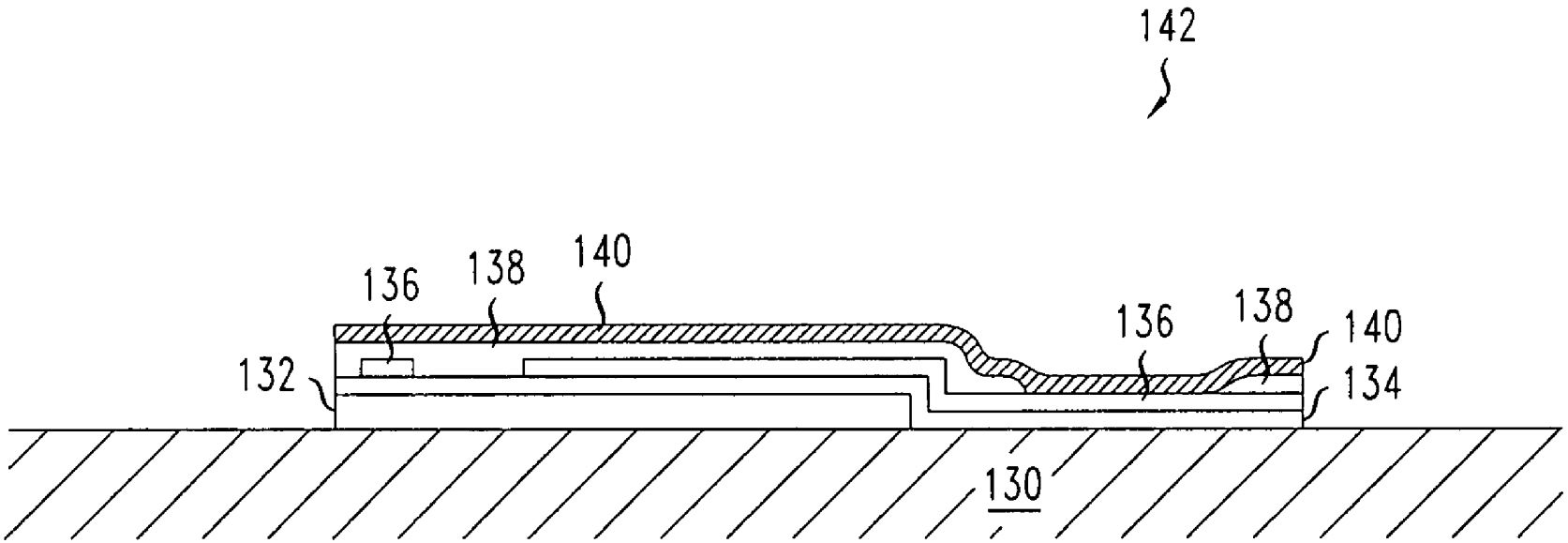
FIGS. 8-10 illustrate intermediate structures formed by the fabrication process of FIG. 7.
Figure 9:
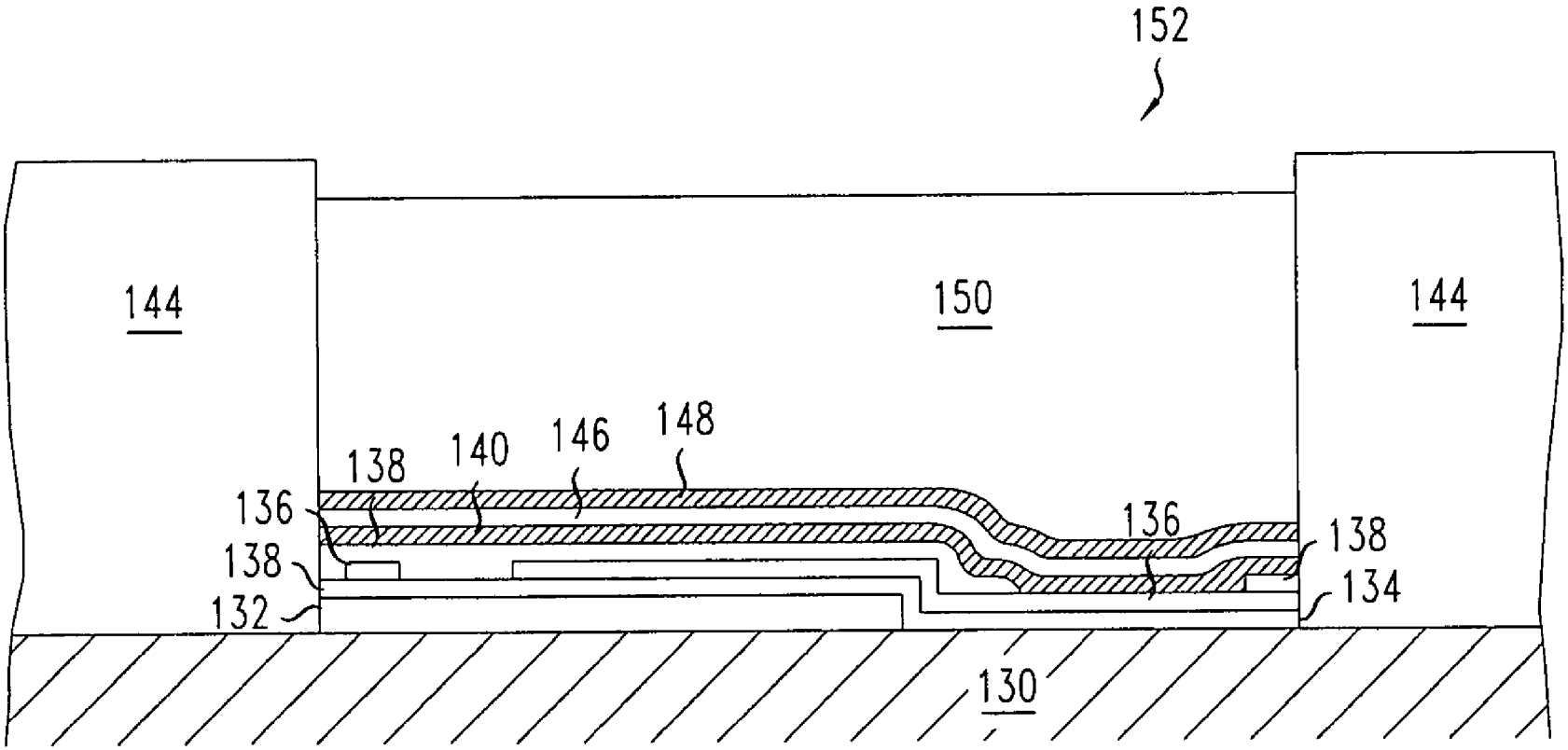

The method 100 includes depositing a thin metal layer 140 under the control of another patterned photoresist mask and then, lifting off the mask to produce intermediate structure 142 of FIG. 8 (step 114). In the intermediate structure 142, the deposited metal layer 140 remains only on the exposed portions of the second silicon nitride and polysilicon layers 138, 136. For example, the thin metal layer 140 remains in areas upon which support portions 72L, 72R of the switch arms 42L, 42R of FIGS. 4D, 4C will be formed. The thin metal layer 140 functions as a seed layer for subsequent electroplating. For electroplating of nickel (Ni), a suitable seed metal may be formed by depositing chromium (Cr) and/or platinum (Pt), e.g., via vapor-deposition processes known to those of skill in the art. For electroplating Ni, an exemplary seed layer includes a Cr layer that is about 10 nanometers (nm) thick and a Pt layer that is about 25 nm thick.

The method 100 includes forming a patterned photoresist mask 144 over the support substrate 130 via a conventional lithographic process (step 116). The patterned photoresist mask 144 exposes the seed metal layer 140 and covers other portions of the surface of the substrate 130. The patterned photoresist mask 144 is thicker than the desired final layer of electroplated metal.

The method 100 includes performing a two-step electroplating of metal for the support portions of the switch arms and electro-mechanical structures of the mechanical switch (step 118). The first step involves electroplating a thin Cr layer 146 having a thickness of about 50 nm and electroplating a thin titanium layer (Ti) 148 having a thickness of about 50 nm onto the metal seed layer. The second step involves electroplating a thick Ni layer 150, e.g., a Ni layer with a thickness of about 10 μm or more, e.g., about 20 μm of Ni, and may include electroplating a thin Au layer over the Ni, e.g., about 0.5 μm of Au. After performing the electroplating, the photoresist mask 144 is stripped away by a convention process. The two-step electroplating step 118 produces an intermediate structure 152 shown in FIG. 9.

The electroplating step 118 can produce several structures of the mechanical switches 40, 90, 40', 90' of FIGS. 4A, 5A, 6A, and 6B. For example, the electroplating step 118 may produce, e.g., the support portions 72L, 72R and the capacitor plates 80L, 80R as shown in FIGS. 4A and 4D. For example, the electroplating step 118 may produce the support portions 72L, 72R and the U-shaped bar 92 as shown in FIGS. 5A and 5C.

The method 100 includes stripping the photoresist mask 144 by a conventional stripping process and forming a new lithographically patterned photoresist mask 154 over the remainder of the intermediate structure 152 produced by the electroplating step 118 (step 120). The new patterned photoresist mask 154 exposes, e.g., the distal ends of the metal support portions 72L, 72R of the switch arms 42L, 42R of FIGS. 4D and 5C and covers remaining portions of the metal structures that were produced at the electroplating step 118, e.g., the comb-drive actuator 44 or the U-shaped bar 92.

The method 100 includes electroplating a barrier layer 156 onto the exposed end portions of the metal switch arms of the intermediate structure 152, e.g., to form the conducting contacts 60L, 60R of FIGS. 4A and 5A (step 122). The electroplated barrier layer 156 may have a thickness of about 1 μm to about 3 μm and may be, e.g., gold or another barrier metal known to those of skill in the art.

Figure 10:
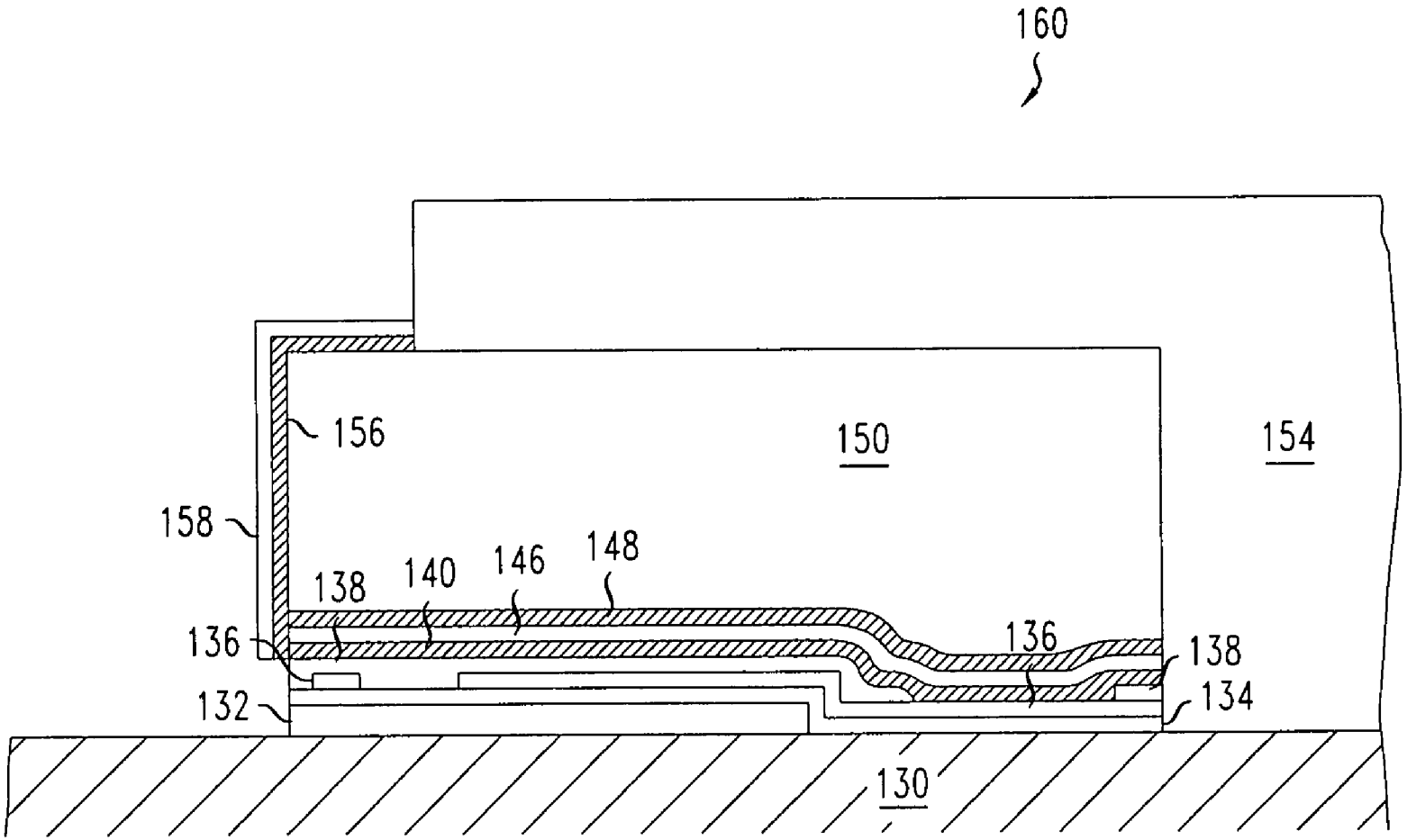

The method 100 includes depositing metal 158 onto the barrier layer 156 of the step 122 under the control of a mask, e.g., to form intermediate structure 160 of FIG. 10 (step 124). The photoresist mask 154 of the steps 120 and 122 may be used to limit the deposition of the metal 158 to the surface of the barrier layer 156 that was formed at the step 122. The deposition may involve electroplating the metal and/or vapor-depositing the metal 158. The deposited metal 158 may form a layer of a single metal or a multi-layer of different metals. The deposited metal 158 has a melting temperature that is both lower than about 350° C. and greater than room temperature. The deposited metal 158 may have any of the compositions described above for the easily melted metal 12 of FIGS. 1-2. After the deposition, the mask, e.g., photoresist mask 154, is stripped away by a conventional process.

The method 100 includes wet etching the structure produced at the step 124 to remove the sacrificial oxide layer 132 thereby release the switch's arm(s) and the electromechanical actuator (step 126). An exemplary wet etchant for the sacrificial oxide layer 132 is a solution about 50 weight percent HF in water.

The release step produces the micro-mechanical switch, e.g., an embodiment of the micro-mechanical switch 40, 90, 40', 90' as illustrated in FIGS. 4D, 5C, 6A, and 6B. After the end portions of the switch arms, e.g., the arms 42L, 42R, are heated, the metal that was deposited at the step 122 will liquefy and bead up due to surface tension to form metal droplet(s), e.g., the metal droplets 62L, 62R of FIGS. 4A, 5A, 6A, and 6B In other embodiments of methods for fabricating micro-mechanical switches, e.g., the micro-mechanical switches 40, 90, 40', 90' of FIGS. 4A-4D, 5A-5C, 6A, and/or 6B, other materials may be substituted for materials recited in above-described method 100. For example, these other methods may replace the specific semiconductor(s), metal(s), and/or dielectric(s) of the method 100 by other materials(s) that would be known to be functionally equivalent and/or suitable by those of skill in the micro-electronics or micro-electromechanical systems (MEMS) arts.

From the above disclosure, the figures, and the claims, other embodiments will be apparent to those of skill in the art.

What we claim is:

1. A mechanical switch, comprising:

a pair of conducting contacts;

metal located on and between the conducting contacts, the metal having a melting temperature that is higher than room temperature and is lower than about 350° C.;

a variable heater operable to apply heat that melts the metal; and an electro-mechanical actuator being capable of moving one or both of the conducting contacts in a manner that causes the metal to either start physically bridging the conducting contacts or to stop physically bridging the conducting contacts; and wherein the electrical switch is configured to cause the variable heater to melt the metal in transitions from a closed-switch state of the switch to an open-switch state of the switch, the metal forming a solid metal bridge physically connecting the conducting contacts in the closed-switch state.

2. The mechanical switch of claim 1, wherein the mechanical switch is in an open-switch state in response to the metal not physically bridging the conducting contacts.

3. The mechanical switch of claim 2, wherein the electro-mechanical actuator includes a capacitor with a movable plate.

4. The mechanical switch of claim 1, further comprising at least one flexible arm; and wherein one of the conducting contacts is located on the arm and the electro-mechanical actuator is connected to move the one of the conducting contacts by rotating or flexing a portion of the arm.

5. The mechanical switch of claim 4, wherein the variable heater includes a resistive heater located on said arm adjacent to said one of the conducting contacts.

6. The mechanical switch of claim 5, wherein the electro-mechanical actuator includes a capacitor having a movable plate.

7. The mechanical switch of claim 5, wherein the electro-mechanical actuator includes a metal bar that is configured to expand or contract in a manner that moves one of the conducting contacts in response to an electrical current passing through the metal bar.

8. The apparatus of claim 1, wherein the metal forms a solid metal bridge physically connecting the conducting contacts.

9. A mechanical switch, comprising:

a pair of conducting contacts;

metal located on and between the conducting contacts;

a heater operable to apply heat that melts the metal; and an electro-mechanical actuator being capable of moving one or both of the conducting contacts in a manner that causes the metal to either start physically bridging the conducting contacts or to stop physically bridging the conducting contacts; and wherein the mechanical switch is in a closed-switch state in response to the metal physically bridging the conducting contacts and is in an open-switch state in response to the metal not physically bridging the conducting contacts; and wherein the electro-mechanical actuator includes a metal bar configured to expand or contract in a manner that moves one of the conducting contacts in response to an electrical current passing through the metal bar.

10. A method, comprising:

moving a first conducting contact towards a second conducting contact such that metal bridges the conducting contacts, and heating the metal, the heating causing the metal to be melted when the first conducting contact has moved towards the second conducting contact; and allowing the melted metal to solidify into a solid metal bridge that physically connects the conducting contacts; and wherein the moving causes a mechanical switch to be in a conducting state, the conducting contacts being configured to carry a current through the mechanical switch in the conducting state; and wherein the heating includes heating the metal to a temperature higher than room temperature, the metal having a melting temperature that is lower than about 350° C.

11. The method of claim 10, further comprising:

heating the solid metal bridge such that metal therein remelts; and then, moving one or both of the conducting contacts such that the metal does not bridge the conducting contacts.

12. A method, comprising:

moving a first conducting contact towards a second conducting contact such that metal bridges the conducting contacts;

heating the metal, the heating causing the metal to be melted when the first conducting contact has moved towards the second conducting contact, the moving causing a mechanical switch to be in a conducting state, the conducting contacts being configured to carry a current through the mechanical switch in the conducting state;

allowing the melted metal to solidify into a solid metal bridge that physically connects the conducting contacts; and passing an electrical current through the switch while the metal forms the solid metal bridge.

13. The method of claim 11, wherein one of the acts of moving includes applying a voltage across a capacitor to cause a plate of the capacitor to move, the plate being connected to move one of the conducting contacts in response to the plate moving.

14. A method, comprising:

moving a first conducting contact towards a second conducting contact such that a solid metal bridge physically connects the conducting contacts, heating the metal, the heating causing the metal to be melted when the first conducting contact has moved towards the second conducting contact, the moving causing a mechanical switch to be in a conducting state, the conducting contacts being configured to carry a current through the mechanical switch in the conducting state;

heating the solid metal bridge such that metal therein remelts; and then, moving one or both of the conducting contacts such that the metal does not bridge the conducting contacts; and wherein one of the acts of moving includes passing a current through a metal bar to thermally expand the bar in a manner that moves one of the contacts.

* * * * *

UNITED STATES PATENT AND TRADEMARK OFFICE

CERTIFICATE OF CORRECTION

PATENT NO. : 7,645,952 B2
APPLICATION NO. : 11/518693
DATED : January 12, 2010
INVENTOR(S) : Bolle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 304 days.

Signed and Sealed this

Twenty-eighth Day of December, 2010

David J. Kappos

David J. Kappos
*Director of the United States Patent and Trademark Office*